US005293012A

United States Patent [19]

Levi

[11] Patent Number: 5,293,012

[45] Date of Patent: Mar. 8, 1994

[54] DISCONNECTING SWITCH

[75] Inventor: Jozef Levi, Mentor, Ohio

[73] Assignee: E Manufacturing Company, Inc., Mentor, Ohio

[21] Appl. No.: 967,799

[22] Filed: Oct. 28, 1992

[51] Int. Cl.[5] ..... H01H 31/00

[52] U.S. Cl. ..... 200/48 P; 200/48 CB; 200/27.5

[58] Field of Search ..... 200/48 P, 48 A, 48 SB, 200/48 CB, 279, 275; 384/300, 296, 275

[56] References Cited

U.S. PATENT DOCUMENTS

| | | | |
|---|---|---|---|
| 2,228,230 | 1/1941 | Howe | 200/48 P |
| 3,134,865 | 5/1964 | Bernatt | 200/48 |
| 3,148,252 | 9/1964 | Bernatt | 200/48 |
| 3,174,004 | 3/1965 | Stene et al. | 200/48 |
| 3,388,229 | 6/1968 | Lyvang | 200/279 X |
| 3,553,412 | 1/1971 | Kerr, Jr. | 200/48 |
| 3,705,279 | 12/1972 | Kerr, Jr. | 200/48 |
| 3,836,737 | 9/1974 | Redfern | 200/48 |
| 3,879,588 | 4/1975 | Cole | 200/48 |
| 4,078,162 | 3/1978 | Turner | 200/48 |
| 4,090,047 | 5/1978 | Worrix | 200/48 P |
| 4,112,268 | 9/1978 | Chung | 200/48 |
| 4,351,383 | 9/1982 | Gladwin | 384/300 X |
| 4,357,503 | 11/1982 | Kowalik | 200/48 |
| 4,481,387 | 11/1984 | Worrix | 200/48 |
| 4,713,500 | 12/1987 | Osborne | 200/48 |
| 4,761,083 | 8/1988 | Smith et al. | 384/208 |
| 4,795,869 | 1/1989 | Roman et al. | 200/255 |

FOREIGN PATENT DOCUMENTS

| | | | |
|---|---|---|---|
| 1365160 | 7/1988 | U.S.S.R. . | |
| 1407405 | 9/1975 | United Kingdom | 384/300 |

*Primary Examiner*—Renee S. Luebke

*Attorney, Agent, or Firm*—Gifford, Groh, Sprinkle, Patmore and Anderson

[57] ABSTRACT

A disconnecting switch with improved contacts in the form of a spool contact having one or more circumferential V-grooves and a finger contact having fingers which are provided internally with spring members for maintaining contact pressure. Spaced plastic inserts provide a maintenance free bearing for rotation of switch members.

16 Claims, 5 Drawing Sheets

DISCONNECTING SWITCH

BACKGROUND OF THE INVENTION

1. Field of the Invention

This invention relates to disconnecting switches. More particularly, the invention relates to high voltage air break disconnecting switches and to improvements in their electrical contacts and the bearing used for rotating members.

2. State of the Art

There is a wide variety of high voltage air break disconnecting switches designed for outdoor use. These switches have been given current and voltage ratings along with various other specifications according to construction classifications in American National Standards. Commonly used constructions include single and double side break, vertical break and center break switches.

In all the various constructions, one or both of the contacts making and breaking the circuit are mounted for rotation or pivoting to swing between an open and a closed position. For example, with a single side break switch, one contact is fixed to the end of an arm or switch blade mounted on a rotating insulator to be rotated or swung into contact with a contact on a fixed insulator. The contact on the fixed insulator may pivot or be stationary depending on additional motion that may be imparted to the rotating arm contact.

In the case of a center break switch, both contacts are fixed on arms mounted on insulators which are rotated.

Many innovations have been made over the years in each of the various switch constructions, usually with the improvement applying only to a specific switch construction.

Little has been done in the area of improved bearing support for the rotating members as evidenced by the fact that a large number of switches still use roller bearings which often fuse or melt in a stationary position under current surge/contact corrosion conditions.

Likewise, there has been very little improvements in the area of insuring the maintenance of contact pressure where one of the contact are configured to supply spring pressure. The phosphorus bronze or other spring material used in such contacts losses its spring resilience when overheated due to arcing and heavy momentary current flow thus losing the effectiveness of the contact to further aggravate the arcing and consequent corrosion of the contact.

While multiple contact elements have been used on one or both of the contacts, each element provides only a single point of contact, which if misaligned, breaks the connection causing arcing.

SUMMARY OF THE INVENTION

The present invention is directed to improvements in contact configuration including maintenance of contact pressure and in the bearing support of the switch rotating members.

In a preferred embodiment of the invention the rotary action disconnecting switch includes a first generally cylindrical contact having two abutting frusto-conical surfaces forming a circumferential V-groove. A second contact is in the form of a cylindrical finger so that when relative rotary motion is applied between the contacts to swing them from an open switch position in which the contacts are spaced apart to a closed switch position, the finger is in contact with both frusto-conical surfaces of the first contact V-groove. This double contact is obviously a vast improvement over the conventional single contact. Moreover, the frusto-conical configuration of the first contact assures the maintenance of the two contact points even with misalignment of the second, finger, contact. With a single first cylindrical contact having a circumferential V-groove, preferably two fingers are brought into contact in the groove on diametrically opposite sides, each finger supplying two contact points.

In a further preferred form of the invention, the first contact is provided with a plurality of axially spaced circumferential v-grooves with the second contact providing opposed finger contacts in each groove.

The preferred construction of the cylindrical finger is with a longitudinally extending central spring element surrounded by a longitudinally extending tube of electrically conductive material. The spring element is preferably made of non-magnetic stainless steel with the conductive tube being copper. Thus, even with heating of the contact, the core of stainless steel will not lose its spring resiliency.

One or both of the contacts is mounted for rotation through a bearing to a stationary terminal with the bearing being a compound bearing having spaced apart bearing inserts made with a plastic resin. Preferably the plastic resin is a metal impregnated PTFE resin. The inserts have load carrying frusto-conical surfaces facing each other preferably at 45° to the axis of the rotation for an even distribution of loading forces.

The foregoing improvements of the invention can be applied to any of the conventional switch configurations.

DRAWING

The advantages of the present invention will be more apparent from the following detailed description when considered in connection with the accompanying drawing wherein.

SUMMARY OF THE PRESENTLY PREFERRED EMBODIMENTS OF THE INVENTION

Figure 1:
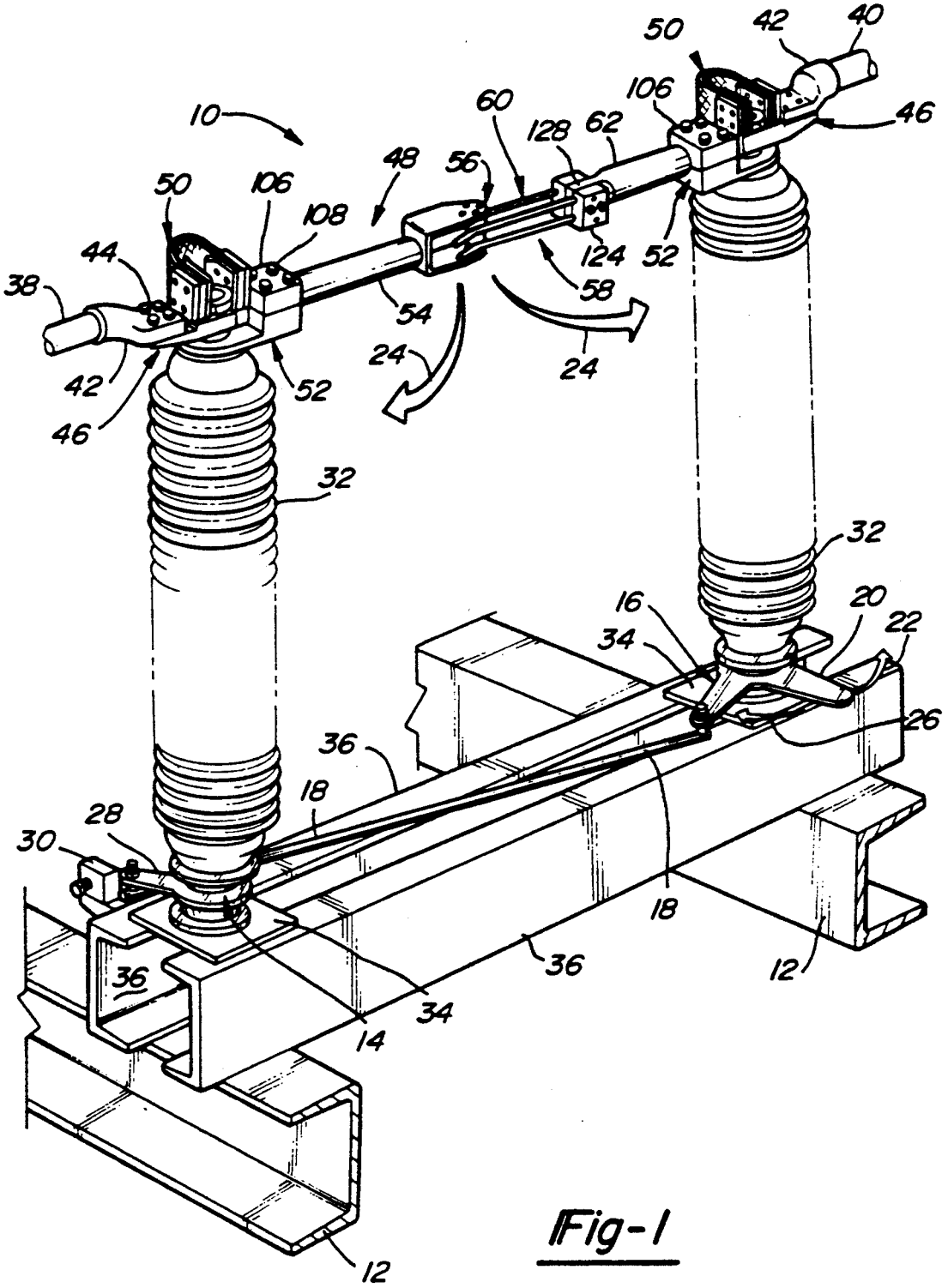
FIG. 1 is a perspective view of a center break disconnecting switch embodying the present invention showing the switch in its closed position and indicating the direction of opening.

Referring to FIG. 1, the disconnecting switch 10 according to the invention is shown as a center break switch which is mounted on superstructure 12. Superstructure 12 is normally the top beam of an open frame structure in a substation, which frame structure houses various electrical components including circuit breakers and the like. The operating mechanism for the switch includes rotating levers 14 and 16 and connection links 18. When arm 20 of lever 16 is rotated in the direction of arrow 22, the switch elements are moved from the closed position shown to an open position in the direction of arrows 24. When the arm 20 of lever 16 is rotated in the direction of arrow 26, the switch elements are moved to the illustrated closed position which may be established and limited by arm 28 of lever 14 acting against adjustable stop member 30. A similar step element (not shown) can be used to establish and limit the open position of the switch.

Lever 20 will be tied into other linkage and mechanisms which, for example, can operate more than one switch simultaneously as for three phase current. The operating mechanism which can include hand operated levers or motor driven devices are located at ground level. The open and closed switch position limits may also be located at ground level and can eliminate the need for stop 30 and lever arm 28.

Rotatable insulators 32 are suitably mounted through platens 34 to a base shown as formed by two channel members 36. It will be appreciated that the base and mounting details can be varied to suit the situation.

Inlet and outlet busses 38 and 40 are attached by connectors 42 with bolts 44 to stationary switch terminal members 46.

Current is carried from inlet bus 38 through a first switch member 48 by stationary terminal member 46, shunt 50, insulator mounting member 52, switch arm 54 and spool contact 56. The current is carried through switch member 58 from finger contact 60 through switch arm 62, insulator mounting member 52, shunt 50 and stationary terminal member 46 to outlet bus 40. The contacts can be reversed with the finger contact 60 being located on the first switch member 48 and the spool contact 56 being located on the second switch member 58.

Figure 3:
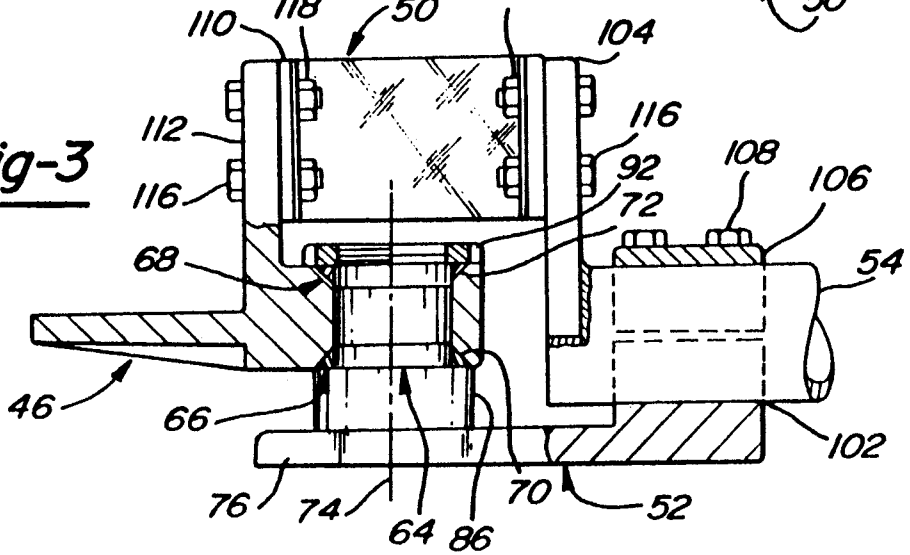
FIG. 3 is an elevational view partially in cross section taken along line 3—3 of FIG. 2 showing the details of construction of one of the switch members including the new bearing support of this invention.
Figure 7:
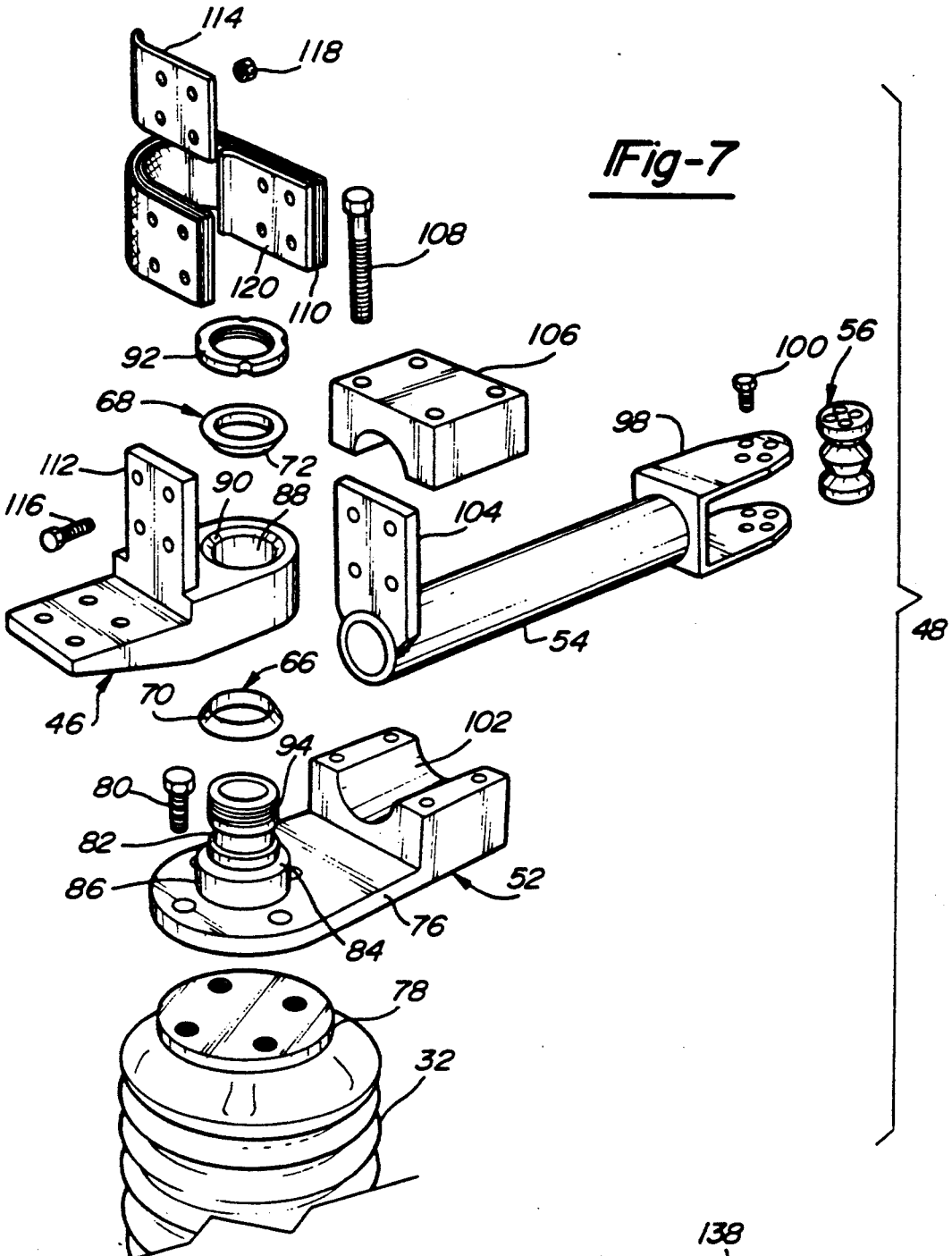
FIG. 7 is an exploded view of one of the rotating contact members.

Since the components are the same for the first and second switch members, or the left side switch member and the right side switch member as seen in FIG. 1, except for the contacts and mounting to their respective arms, the details of only the spool contact switch member is shown in detail in FIGS. 3 and 7. Like components for switch members 48 and 58 are numbered the same, as primarily seen in FIG. 1.

FIG. 3 shows the assembled bearing 64 of this invention which includes spaced lower insert member 66 and upper insert member 68. These insert members are made with plastic resin having high strength and lubricity properties under the extremes of ambient temperature variation and weather conditions encountered in its outdoor use. A metal impregnated plastic such as a bronze impregnated PTFE plastic resin is preferred. Accro-Seal Company's Accrolon 801 compound with 55% bronze and 5% molybdenum disulphide by weight blended in a PTFE base is a preferred bearing material.

The opposed frusto-conical load bearing surfaces 70 and 72 of inserts 66 and 68 are disposed at 45° to axis 74 of the bearing evenly distributing forces to keep the bearing 64 free running under combined thrust and radial loading. The inserts are sized relative to the stationary terminal member 46 and rotatable insulator mounting member 52 to be an insulator between the members, with the current being conveyed through flexible shunt 50. The bearing will maintain integrity even with contact arcing heat up, and no external lubrication is required. This maintenance free bearing is a vast improvement over conventional bearings, even those constructed with stainless steel ball bearings riding in stainless steel races and having Teflon® seals. These state of the art ball bearings are still subject to freezing in a closed position due to melt down in a high electrical resistance current path created by arcing and corrosion. As shown in FIG. 7, switch member 48 (and switch member 58) with its bearing 64 can be assembled by first attaching flange 76 of the insulator mounting member 52 to insulator flange 78 by bolts 80. Lower bearing insert 66 is slipped over bearing spindle 82 of the insulator mounting member 52 to rest on shoulder 84 of boss 86. Spindle 82 is received in spindle hole 88 of switch terminal 46. Next the upper insert 68 is slipped over spindle 82 with its conical load bearing surface 72 seating against chamfer 90. Finally retainer nut 92 is screwed on the threaded end 94 of spindle 82 to retain the member 52 for rotation relative to terminal 46.

Spool contact 56 can be preassembled to yoke end 98 of switch arm 54 by bolts 100.

Switch arm 54 is placed in cradle 102 of the insulator mounting member 52 with its shunt mounting plate 104 being inward of the cradle. Yoke retainer 106 is fastened to cradle 102 with bolts 108 firmly anchoring switch arm 54 to the assembly.

Shunt 50 includes a stack of thin silver plated copper strips 110 which are held at one end between mounting flange 112 of terminal member 46 and mounting plate 114 by bolts and nuts 116 and 118. Shunt 50 is mounted at its other end between shunt mounting flange 104 on switch arm 54 and mounting plate 120 by bolts and nuts 116 and 118. The use of stacked thin copper sheets 110 in shunt 50 provides the necessary flexibility for movement of the switch arm 54 relative to fixed terminal 46 but provides stiffness against bending not supplied by a braided connection.

Figure 2:
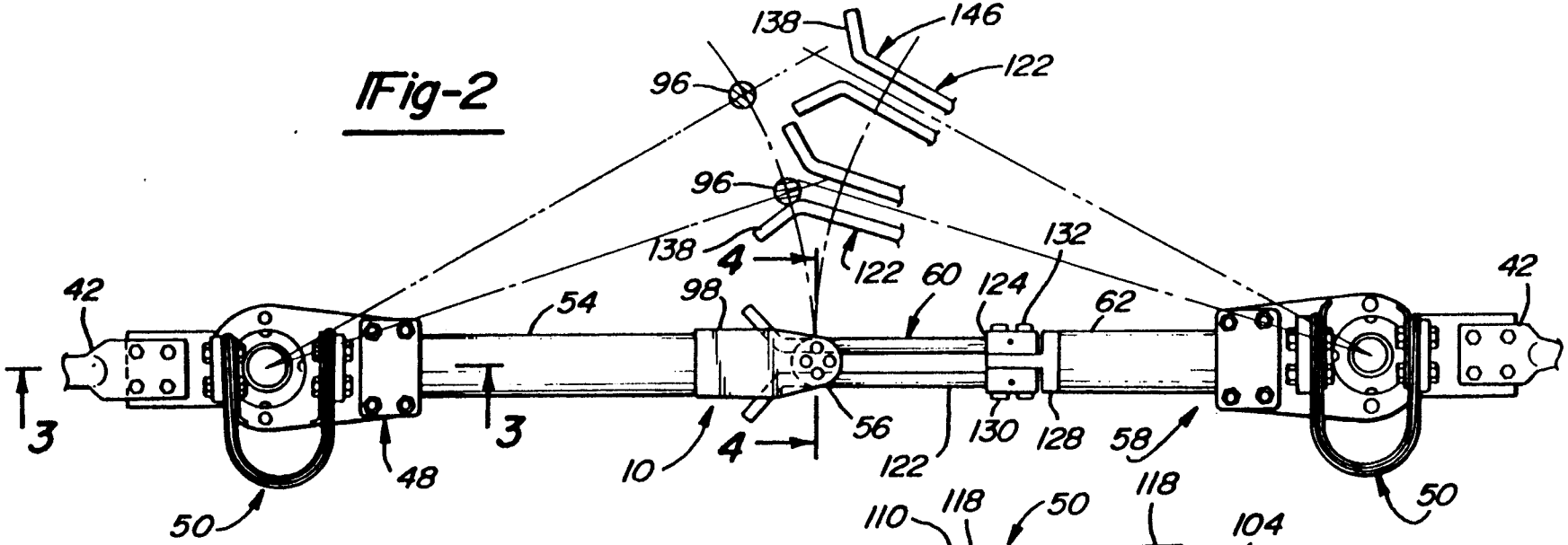
FIG. 2 is a top view of the switch of FIG. 1 showing the switch in its closed position and showing how contact is established during the closing mode.
Figure 5:
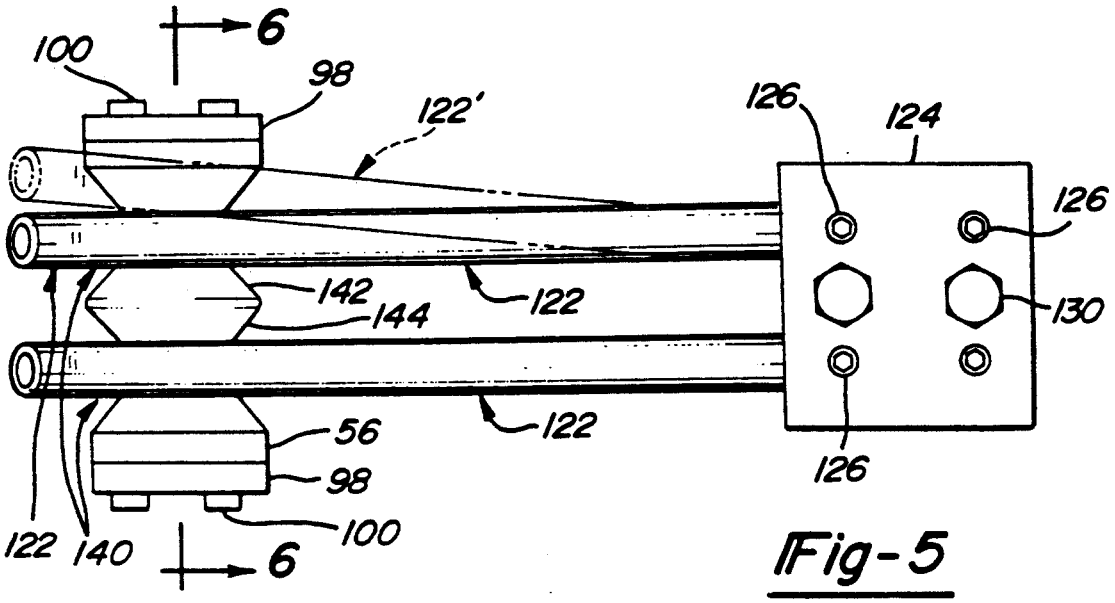
FIG. 5 is an elevational view showing the self aligning feature of the finger contacts with the frusto-conical groove contact, the misaligned contact finger being shown in phantom before it is brought into alignment.
Figure 8:
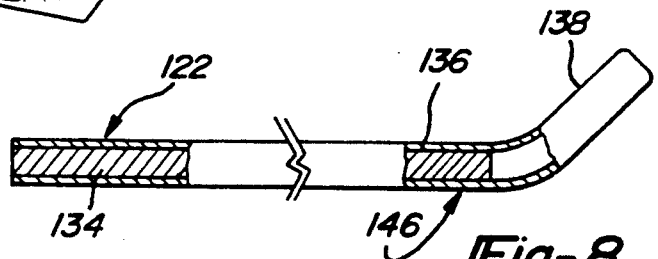
FIG. 8 is a view partially in section of one of the finger contacts showing the internal spring member and the external conductor member.

Switch member 58 is assembled in the same manner as switch member 48 except that the spool contact 56 is replaced with finger contact 60. Individual contact fingers 122 are held in mounting blocks 124 by set screws 126 as best seen in FIG. 5. The free end of switch arm 62 has a tongue 128 (see FIG. 1) which receive bolts 130 passing through the mounting blocks 124 on both sides of the tongue and is secured with nuts 132 as seen in FIG. 2. Referring to FIG. 8, the individual contact fingers 122 are formed with an inner stainless steel rod 134 which serves as a spring element and an outer copper tube 136 which acts as a conductor. The spring rod 134 extends substantially the entire longitudinal length 146 of the finger stopping short of a guide end 138 which is bent outwardly at an angle between 30° and 60°. The stainless steel spring core is preferably made with a non magnetic material such as 304 stainless steel. The copper tube is preferably silver plated for minimum contact resistance.

The generally cylindrical spool contact member 56 is formed with two V-grooves 140 to present two abutting frusto-conical contact surfaces 142 and 144 for each groove which makes contact with individual fingers 122. Preferably the spool contact is silver plated also for minimum electrical resistance.

Figure 4:
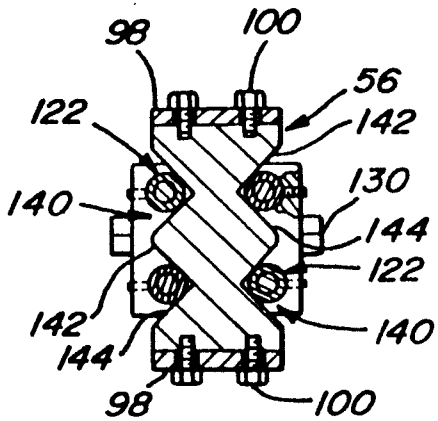
FIG. 4 is a cross sectional view taken along line 4—4 of FIG. 2 showing the dual contact established between a finger contact and the circumferential v-groove of a cylindrical spool contact.

It can be seen, particularly in reference to FIG. 2 that with the individual fingers 122 of finger contact 60 arranged with their free ends 138 diverging outwardly from the axis of switch arm 62 that they act as guides as the spool contact arm 54 and the finger contact arms 62 of switch members 48 and 58 are rotated towards a closed position with the fingers 122 engaging the circumferential V-groove 140 of the spool contact 56. As the arms reach the fully closed position of the switch, the spool is driven into the longitudinally extending portion 146 of the fingers 122 where the full spring force exerted by internal spring member 134 acts to effect two point contact in each circumferential groove 140, namely against both frusto-conical surfaces 142 and 144. With the preferred arrangement of a pair of parallel fingers, contact is made on diametrically opposite sides of the spool, providing four contacts per groove. In the illustrated switch, two V-grooves 140 are used providing eight points of contact with four fingers as seen in FIG. 4. The number of grooves and fingers can be increased as needed.

Figure 6:
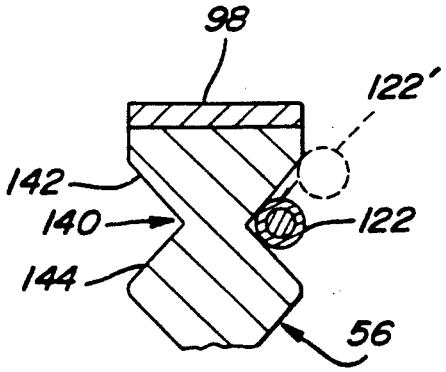
FIG. 6 is a sectional view along line 6—6 of FIG. 5 showing the alignment of the finger contact.

Moreover, the circumferential V-groove 140 of spool contact 56 provides an aligning function for the fingers so that if one of the fingers is bent out of alignment as shown in phantom at 122' in FIGS. 5 and 6, one of the conical surfaces 142 or 144 will guide the finger into the groove and into full contact with both surfaces.

The unique circumferential V-groove contact and the unique finger contact with its internal spring can be used in any of the conventional switch constructions. Likewise the unique bearing construction can be used with any of the rotating contact members.

Figure 9:
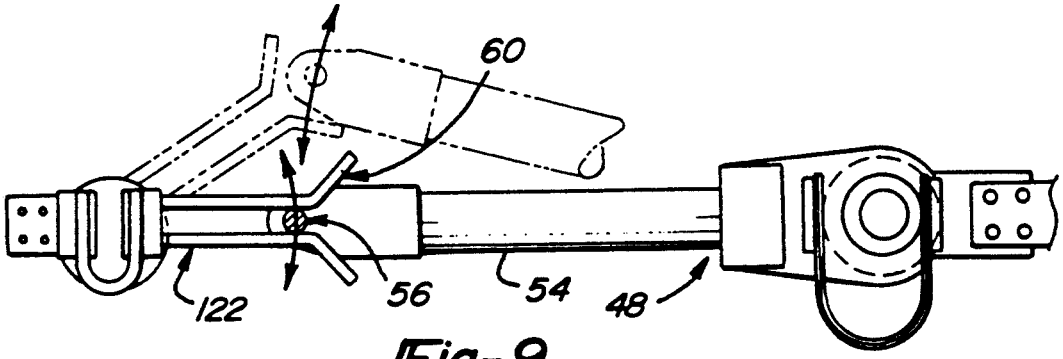
FIG. 9 is a top view of a modified center break switch incorporating the invention.

A modification of the center break switch of FIG. 1 is shown in FIG. 9 wherein only one contact utilizes a switch arm with the other contact being mounted directly on the rotatable insulator. In particular, switch member 48 utilizes arm 54 to carry spool contact 56 whereas the switch member 58 mounts the individual fingers 122 on top of the insulator assembly. Both contacts are still rotated as shown.

Figure 10:
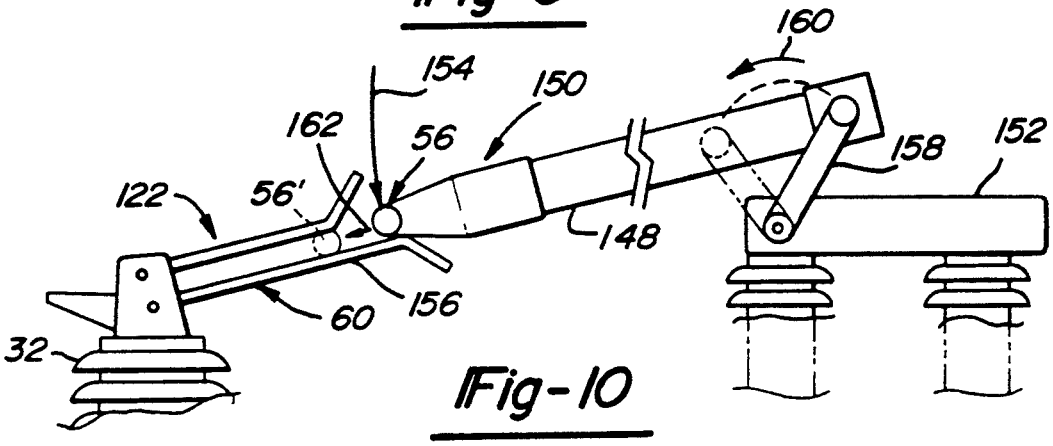
FIG. 10 is a side elevation of the invention applied to a vertical break switch in which one of the two contacts is stationary.

In FIG. 10 a vertical disconnecting switch 150 is shown with finger contact 60 mounted in a stationary position on insulator 32. Spool contact 56 is mounted on an arm 148 actuated by a mechanism 152 to swing in a vertical direction as indicated by an arrow 154. Lower finger 156 is increased length over upper finger 122 to provide guiding the spool contact 56 after the arm 148 has been rotated to the position shown. Linkage 158 is pivoted in the direction of arrow 160 to provide linear motion of contact 56 in the direction of arrow 162 to move the spool contact into the position shown at 56'.

Figure 11:
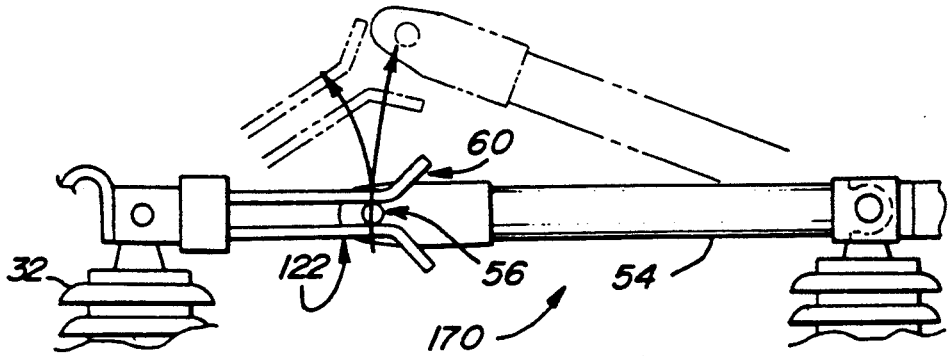
FIG. 11 is an elevational view of a vertical break switch embodying the present invention with both contacts being rotating contacts.

FIG. 11 is a showing of another vertical break switch constructed in a fashion similar to the horizontal break switch shown in FIG. 9. Spool contact 56 is mounted at the end of switch arm 54, and finger contact 60 is mounted for rotation directly on insulator 32.

It will be seen from the description of the presently preferred embodiments that the invention may be incorporated into many different switch constructions with modification being made as needed. It will also be seen that the construction provides easy disassembly and replacement of the contacts. Set screws 126 release individual finger contacts, and bolts 100 release the spool contact. It will also be seen that the spool can be repositioned 90° from its installed position should pitting occur in the contact surfaces 142 and 144.

The embodiments of the invention in which an exclusive property or privilege is claimed are defined as follows:

1. A rotary action disconnecting switch comprising:

a first generally cylindrical contact having two abutting frusto-conical surfaces forming a circumferential V-groove;

a second contact in the form of a cylindrical finger; and means imparting relative rotary motion between said contacts to swing from an open switch position in which said contacts are spaced apart to a closed switch position in which said finger is in contact with both frusto-conical surfaces of said V-groove.

2. The switch according to claim 1 wherein said second contact has two fingers in contact with both of the frusto-conical surfaces of said V-groove on diametrically opposite sides when said switch is in its closed position.

3. The switch according to claim 1 wherein said first contact has a plurality of axially spaced circumferential V-grooves and said second contact has a plurality of fingers, each of said fingers being in contact with both of the frusto-conical surfaces of different ones of said V-grooves when said switch is in its closed position.

4. The switch according to claim 3 wherein said second contact has a plurality of pairs of fingers, both of the fingers of each pair being in contact with both of the frusto-conical surfaces of one of the V-grooves on diametrically opposite sides when said switch is in its closed position.

5. The switch according to claim 1 wherein said cylindrical finger has a longitudinally extending central spring element surrounded by a longitudinally extending tube of electrically conductive material.

6. The switch according to claim 5 wherein said central spring element is stainless steel and said conductive tube is copper.

7. The switch according to claim 6 wherein said stainless steel is non-magnetic.

8. The switch according to claim 1 wherein one of said first and second contacts is mounted at one end of a rotatable switch arm.

9. The switch according to claim 8 wherein both of said first and second contacts are mounted at ends of rotatable switch arms.

10. The switch according to claim 8 wherein another end of said rotatable switch arm is mounted through a bearing to a stationary switch terminal, said bearing being a compound bearing having spaced apart bearing inserts made with a plastic resin.

11. The switch according to claim 10 wherein said plastic resin is a metal impregnated PTFE.

12. The switch according to claim 11 wherein said bearing inserts are made with a bronze impregnated PTFE resin.

13. The switch according to claim 10 wherein said spaced apart inserts have load carrying frusto-conical surfaces facing each other.

14. The switch according to claim 13 wherein said frusto-conical surfaces are at 45° to an axis of rotation.

15. A rotary action disconnecting switch comprising:

a first contact;

a second contact;

at least one of said first and second contacts being mounted for rotation through a bearing to a stationary switch terminal, said bearing being a compound bearing having a pair of spaced apart inserts providing a pair of opposed frusto-conical load carrying friction bearing surfaces facing each other, said inserts being made with a plastic resin; and means imparting relative rotary motion between said contacts by rotation of said at least one of said first and second contacts to swing from an open switch position in which said contacts are spaced apart to a closed switch position in which said contacts are maintained in contact with each other.

16. The switch according to claim 15 wherein said bearing inserts are made with a metal impregnated PTFE resin.

* * * * *